US009347665B2

(12) United States Patent
Gadini et al.

(10) Patent No.: US 9,347,665 B2
(45) Date of Patent: May 24, 2016

(54) DEVICE FOR CONTROLLING GAS SUPPLY TO A BURNER

(75) Inventors: Costanzo Gadini, Alessandria (IT); Paolo Colombo, Alessandria (IT)

(73) Assignee: ELTEK S.P.A., Casale Monferrato (Alessandra) (IT)

( * ) Notice: Subject to any disclaimer, the term of this patent is extended or adjusted under 35 U.S.C. 154(b) by 1012 days.

(21) Appl. No.: 13/319,425

(22) PCT Filed: May 20, 2010

(86) PCT No.: PCT/IB2010/052242

§ 371 (c)(1),
(2), (4) Date: Dec. 14, 2011

(87) PCT Pub. No.: WO2010/134040

PCT Pub. Date: Nov. 25, 2010

(65) Prior Publication Data

US 2012/0115096 A1 May 10, 2012

(30) Foreign Application Priority Data

May 20, 2009 (IT) ..... TO2009A0385

(51) Int. Cl.
*F23N 5/20* (2006.01)
*F16K 31/44* (2006.01)
(Continued)

(52) U.S. Cl.
CPC ..... *F23K 5/007* (2013.01); *F23N 1/007* (2013.01); *F23N 5/107* (2013.01); *F23N 5/203* (2013.01);
(Continued)

(58) Field of Classification Search
CPC .. F16K 31/485; F23N 5/102; F23K 2401/201
USPC ..... 431/87, 18, 45, 67, 73, 86
See application file for complete search history.

(56) References Cited

U.S. PATENT DOCUMENTS 2,810,525 A 10/1957 Wantz
3,341,119 A 9/1967 Tyler
(Continued)

FOREIGN PATENT DOCUMENTS

EP 0120681 10/1984
GB 2197738 5/1988

OTHER PUBLICATIONS

International Search Report for PCT/IB2010/052242 mailed Aug. 27, 2010.
Written Opinion of the International Searching Authority mailed Aug. 27, 2010.

*Primary Examiner* — Alissa Tompkins
*Assistant Examiner* — Benjamin W Johnson
(74) *Attorney, Agent, or Firm* — Nixon & Vanderhye P.C.

(57) ABSTRACT

A gas supply control device for an apparatus, particularly a coking apparatus, includes timing means (20) and a first command means (12) for manually setting a an opening time interval of a safety valve of a gas tap (1), equipped with a second command means (6). In an installed condition of the control device (10), the command means (6, 12) are operable from outside the structure (7) of the apparatus, with the first command means (12) and the second command means (6) substantially rotating around one same axis, one independent from the other. The timing means (20) of the control device (10) belong to a functional unit (10*a*) which is coupled or configured for coupling with a portion of the body of the tap (2) which portion, in the above mentioned installed conditions, is located inside the structure (7) of the apparatus. The functional unit (10*a*) includes switch means (22), controllable by timing means for cutting off the electric current to a solenoid of the tap (1) at the end of a time interval set through the first command means (6), and hence causing the passage of the valve to the respective closed condition.

20 Claims, 9 Drawing Sheets

(51) Int. Cl.

| | |
|---|---|
| ***F24C 3/12*** | (2006.01) |
| ***F23K 5/00*** | (2006.01) |
| ***F23N 5/10*** | (2006.01) |
| *F23N 1/00* | (2006.01) |
| *F23N 5/12* | (2006.01) |

(52) U.S. Cl.

CPC . *F23K 2401/201* (2013.01); *F23K 2900/05001* (2013.01); *F23N 1/00* (2013.01); *F23N 5/12* (2013.01); *F23N 5/20* (2013.01); *F23N 2035/12* (2013.01); *F23N 2035/18* (2013.01); *F23N 2035/22* (2013.01); *Y10T 137/86397* (2015.04)

(56) References Cited

U.S. PATENT DOCUMENTS

| | | | | |
|---|---|---|---|---|
| 4,823,838 | A | 4/1989 | Ferlin | |
| 5,670,074 | A * | 9/1997 | Kass et al. | 219/481 |
| 2002/0189693 | A1 * | 12/2002 | Berto | 137/628 |
| 2004/0100724 | A1 * | 5/2004 | Cho | 360/97.01 |
| 2005/0233273 | A1 | 10/2005 | Colombo | |
| 2008/0057451 | A1 * | 3/2008 | Fujiwara | 431/12 |
| 2008/0268388 | A1 * | 10/2008 | Zanella et al. | 431/38 |

* cited by examiner

DEVICE FOR CONTROLLING GAS SUPPLY TO A BURNER

This application is the U.S. national phase of International Application No. PCT/IB2010/052242 filed 20 May 2010 which designated the U.S. and claims priority to IT TO2009A000385 filed 20 May 2009, the entire contents of each of which are hereby incorporated by reference.

FIELD OF THE INVENTION

The present invention refers to a device for controlling gas supply, for an apparatus having a bearing structure and one or more gas burners, or similar flame generators supplied with gas. More particularly, the invention regards such control device equipped with a timing function, aimed at allowing presetting a desired gas supply time interval of a respective burner.

PRIOR ART

Control devices provided with a timing function for gas burners are known.

In some solutions, the device consists of an electric or electronic control unit, configured for controlling all burners of the apparatus (see for example EP-A-1.887.284). This control unit is provided with its own control means capable of allowing setting the time interval for which a given burner shall be kept ON. At the end of the set interval, the control unit causes the closure of a safety valve associated to the burner, and thus causing the burner itself going OFF. The control unit is thus a separate unit with respect to the gas taps that control the burners, and requires considerable housing space within the structure of the apparatus. Also due to the limited space available inside the apparatus, the installation of the control unit is relatively complex, and requires a particular configuration of the control panel of the apparatus. As a matter of fact, these control units are provided with their own control means, at a remote position with respect to the control knobs of the burner. Thus, the user is required to operate on several spatially distinct control means, and this may lead to possible setting errors (for example by setting an ignition time for a given burner and then inadvertently igniting a different burner).

In other known solutions, the control device that performs the timing function is operatively coupled to a respective gas tap. Thus, in these solutions associated to each tap of the apparatus is the respective timing device. These solutions generally provide for that the tap control knob be coaxial to a timing device knob. This allows eliminating the risk related to erroneous setting of the burner activation time interval, due to the fact that the control means are substantially "grouped" together. In these solutions, the timing device is mechanical, usually based on the use of a loadable spring, and it is housed in a respective control knob (see for example U.S. Pat. No. 5,404,910).

These devices are configured such that, upon expiry of the time interval initially set by the user, the device itself mechanically causes the closure of the gas tap, causing the rotation of the respective knob. The advantage of this type of solution lies in the fact that the timing device is installed outside the structure of the apparatus, so as not to occupy space therein. On the other hand, in such solutions, the timing function control knob is relatively cumbersome, specifically due to the fact that it houses a timing mechanism.

SUMMARY OF THE INVENTION

An aim of the present invention is substantially that of overcoming the abovementioned drawbacks and providing a control device—of the type wherein the tap control means or a gas valve and the means for controlling the device itself are substantially mounted coaxial with respect to each other—having a simple structure, having limited overall dimensions, being easy to mount and being versatile in application.

This, and other aims, which shall be clearer hereinafter are attained according to the present invention by a control device having the characteristics indicated in claim 1. Preferred characteristics of the invention are indicated in the sub-claims. The claims form an integral part of the technical disclosure provided herein in relation to the invention.

BRIEF DESCRIPTION OF THE DRAWINGS

Further aims, characteristics and advantages of the present invention shall be clear from the detailed description that follows and from the attached drawings, strictly provided for exemplifying and non-limiting purposes, wherein.

DESCRIPTION OF PREFERRED EMBODIMENTS OF THE INVENTION

Figure 1:
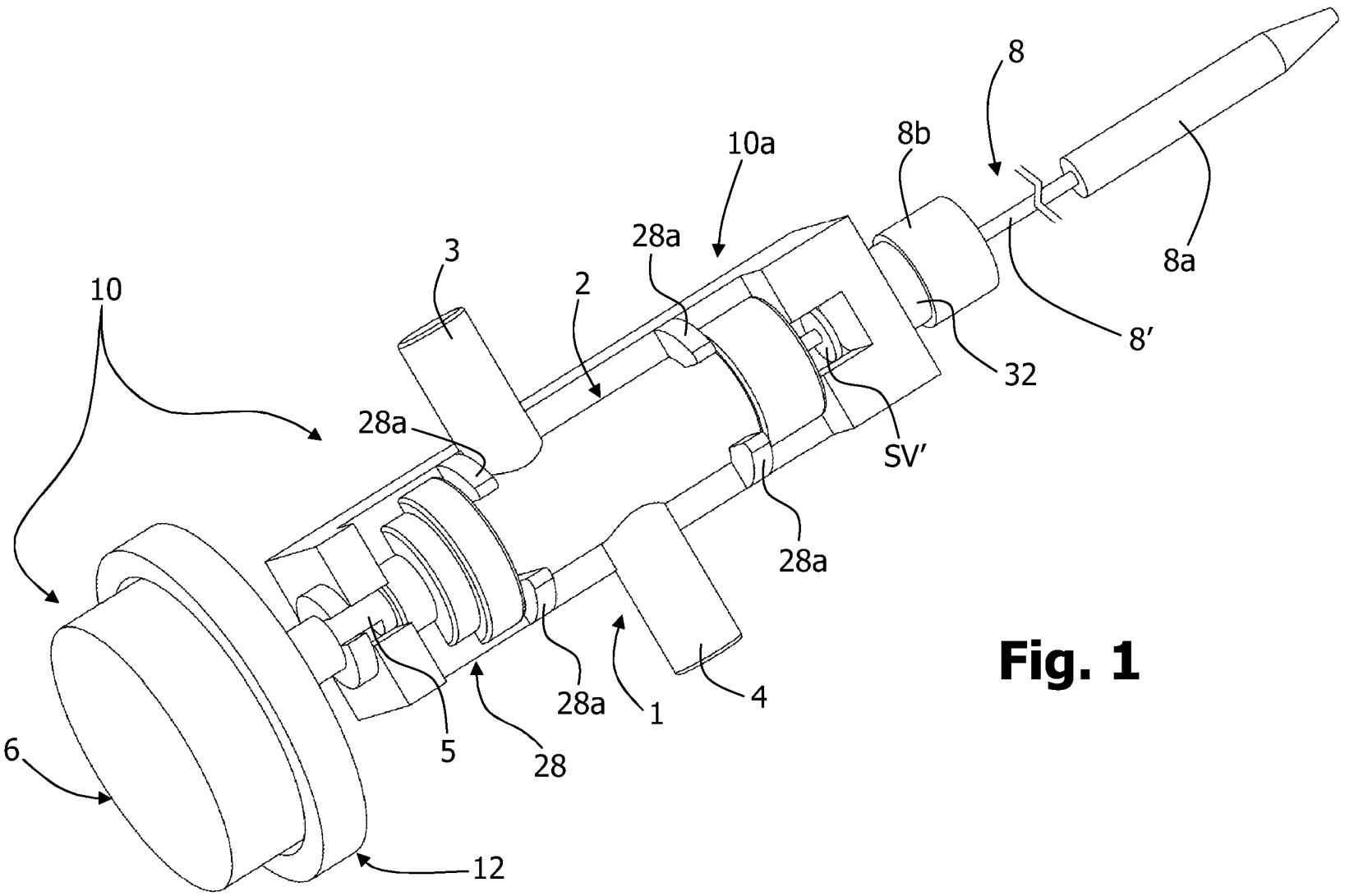
FIG. 1 is partial and schematic perspective view, of a gas tap or valve with a control device associated thereto according to a first embodiment of the present invention.
Figure 2:
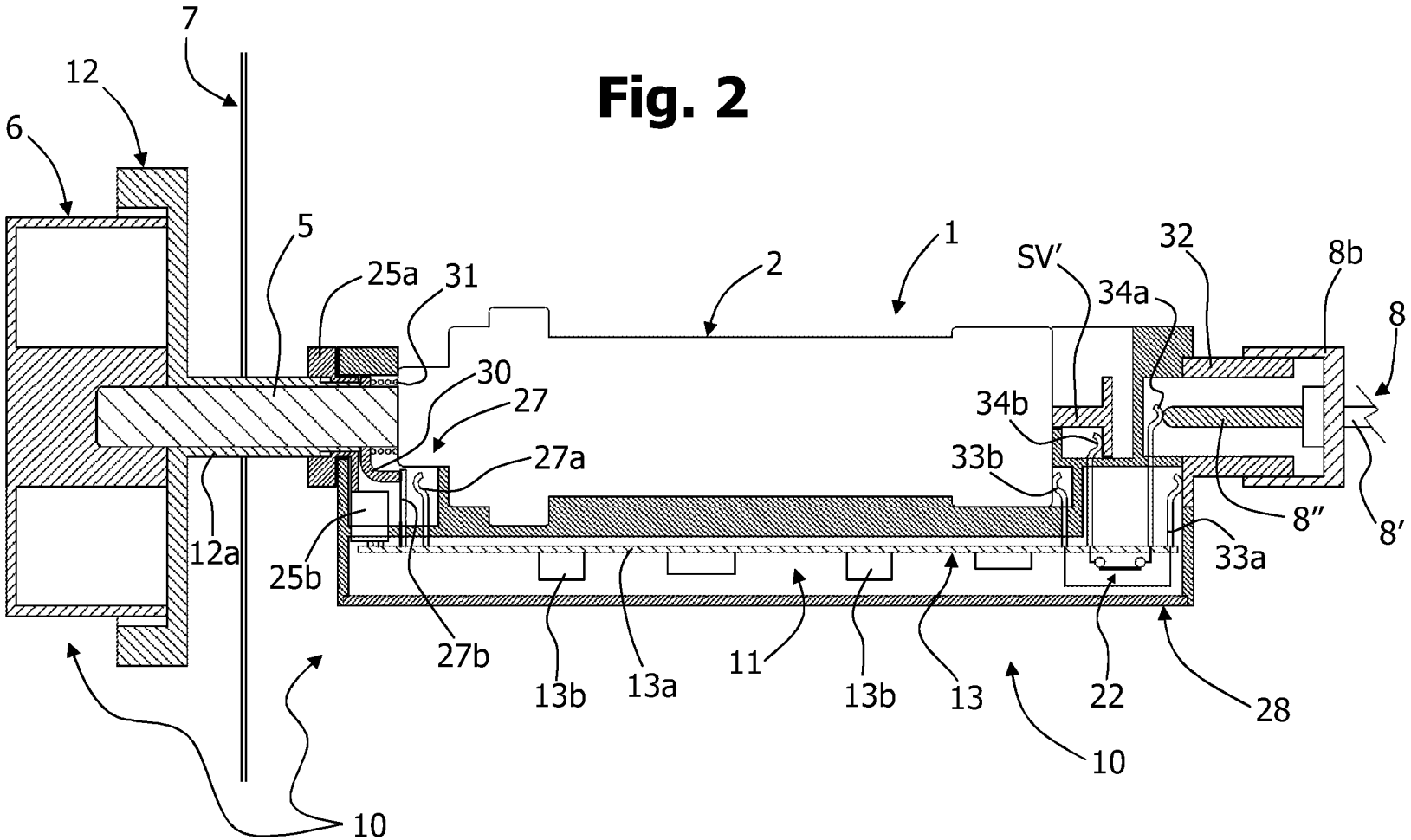
FIGS. 2 and 3 are schematic sections of the gas tap and of the control device of FIG. 1, in two different conditions.
Figure 3:
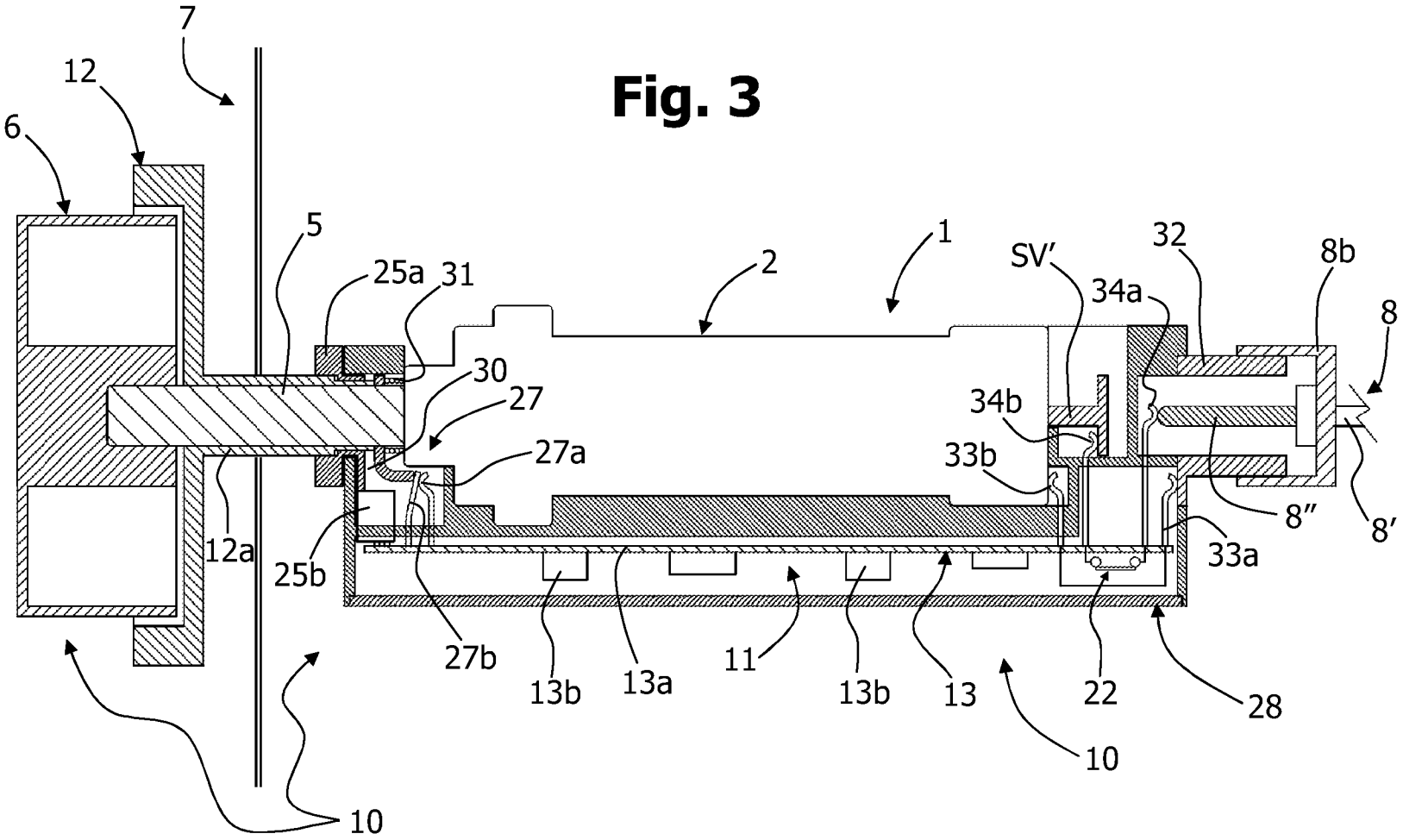

Indicated in its entirety with 1 in FIGS. 1-3, is a gas tap or valve, of a generally known conception, having a tap body 2, preferably made of metal material and configured for connection in a gas supply line with a single gas burner, or similar gas combustion device, of a general apparatus, herein assumed to be a household cooking apparatus, such as a cooking hob or an oven; the invention may however be applied to other types of apparatus provided with gas burners or heaters, such as household and/or domestic water heating apparatus (such as for example a wall-mounted gas boiler).

For such purpose, the tap body 2 is provided with an inlet 3, intended for connection to a gas supply line, not represented, and an outlet 4, intended for connection with a pipe for supplying gas to the burner controlled by the tap 1. Mounted in the tap body 2 are means for adjusting the flow of the gas introduced from the inlet 3 to the outlet 4, conceived in a per se known manner, for example made up of a shutter adjustable in position by means of a manoeuvring shaft 5. The abovementioned shaft 5 projects axially from a proximal end of the tap body 2 and it is suitable to rotate around its own axis, with the aim of obtaining the abovementioned adjustment of the gas flow.

Coupled to the manoeuvring shaft 5 is a respective command means 6, which in the represented example consists of a knob 6; a rotation imparted manually to the knob 6 causes the rotation of the shaft 5, and thus the abovementioned adjustment of the gas flow, the entire operation being attained through extensively known art.

As observable in FIGS. 2 and 3, in the installed condition of the tap 1, at least one substantial or main portion of the body 2 (and preferably substantially the entire body 2), is positioned within the structure or cabinet of the apparatus, represented solely partly and schematically indicated with 7. The tap is fixed according to the known art to the structure 7 through suitable means, not represented. From FIGS. 2 and 3 it is also observable how, in the abovementioned installed condition of the tap 1, the knob 6 is located outside the structure 7, so as to allow manual operation thereof by a user of the apparatus.

The tap 1 is internally provided with a safety valve, not shown, suitable to be maintained in the respective open condition through an electromagnet or solenoid. Such valve is conceived in a manner well known in the art, and thus it shall not be described in detail herein. Here, it should be simply pointed out that such valve is of the open/closed type, to allow or hinder the flow of gas to the burner, respectively. The solenoid of the valve is supplied through a thermoelectric generator which, in the example represented in the figures, is made up of a thermocouple 8, connected to a distal end of the tap body; the thermocouple has a sensitive part 8*a*, or hot joint, intended to be installed in proximity to the burner controlled by the tap 1, such burner being represented solely schematically in FIG. 5, where it is indicated with 9.

Like in the prior art, when the burner 9 is ON, the sensitive part 8*a* of the thermocouple 8 generates a current in response to the heat generated by the flame on the burner 9. This current supplies the solenoid of the abovementioned safety valve, which maintains the shutter of the latter (associated to a moveable core attracted by the solenoid) in the respective open condition, countering the action of a spring. Thus, substantially, as long as the burner is ON, the current is generated and the solenoid keeps the valve open; when the burner 9 is switched OFF manually, or goes OFF inadvertently, the power supply to the solenoid is interrupted, and the valve is closed, biased for this purpose by the abovementioned spring, in such a manner to prevent the passage of the gas between the inlet 3 and the outlet 4 of the tap body 2.

Due to the abovementioned reasons, in a preferred application, the tap 1 is of the type wherein the manoeuvring shaft 5 is suitable to translate along its axis, in an actuation direction, against the action of elastic means inside the tap body 2. Such translation or sliding is obtainable by pressing the knob 6 towards the tap body 2, i.e. towards the structure 7, after initially rotating the knob 6 in such a manner to allow a flow of gas to the burner. Thus, the axial displacement of the shaft 5, caused manually by operating on the knob 6, causes an initial opening of the safety valve; the knob is kept in the pressed condition until the flame is ignited on the burner: as mentioned, in the presence of the flame, the thermocouple 8 generates the current which, through the solenoid, keeps the valve in the open condition; thus, after igniting the flame the user may release the knob 6.

Furthermore, in an embodiment, a gas ignition system is provided, of the type suitable to generate sparks in proximity to the burner, so as to ignite the flame. Also such ignition system is conceived in a manner per se known in the art, and thus it shall not be described herein. Here, it suffices pointing out that the igniter comprises two control terminals, indicated with S+ and S− in FIG. 5, belonging to a circuit including two electrodes of the known type, not represented, generated between which are the abovementioned sparks following an electric discharge. Advantageously, and according to per se known art, the igniter may be activated exploiting the configuration of the tap 1, and specifically the possibility of the manoeuvring shaft 5 to slide or translate along its own axis. Therefore, pressing the knob 6 after rotating it at least slightly, alongside causing the initial opening of the safety valve, also causes the activation of the abovementioned ignition system.

Indicated in its entirety with 10 in FIGS. 1-3, is a device for controlling gas supply to the burner 9, which forms the specific object of the present invention.

The device 10 is conceived to serve at least one flame ignition timing function on a single or respective burner, and includes—for such purpose—timing means, generally indicated with 11 in FIGS. 2 and 3, described hereinafter, as well as respective command means 12, for setting the abovementioned time interval; in the illustrated example, the abovementioned command means is made up of a knob 12, prearranged for coupling or assembling on the tap; as observable hereinafter, the knob 12 is operable for manual setting of a desired time interval for opening the safety valve of the tap 1.

As observable in FIGS. 2 and 3, in the installed condition of the device 10, the knob 12 is operable from outside the structure 7 of the apparatus, with the two knobs 6 and 12 being substantially coaxial or rotatable at least partly, i.e. with rotations even smaller than 360°, around the same axis.

Furthermore, as observable hereinafter the two knobs 6 and 12 are rotatable independently with respect to each other, to allow, on one hand, the adjustment of the gas flow admitted to the burner 9, and on the other hand, the setting of the abovementioned time interval; in an embodiment, the two knobs 6 and 12 are also moveable axially one independent from the other, with the possibility of combined movements (for example, pressing the knob 6 leads to the ensuing pressing of the knob 12).

According to a main aspect of the invention, at least the abovementioned timing means 11 of the device belong to a functional unit, indicated with 10*a*, which is coupled or configured for coupling with a portion of the tap body 2, and particularly a portion of the body 2 which, in the installed condition of the tap 1 and of the device 10, is located inside the structure 7 of the apparatus. Furthermore, according to a preferential characteristic of the invention, the abovementioned functional unit 10*a* includes control means, which are controllable by the timing means 11 to interrupt or control the electrical power supply to the solenoid of the safety valve, in particular at the end of the time interval set through the knob 12, and thus cause the passage of the abovementioned valve to the respective closed condition.

In the illustrated non-limiting embodiment of the invention, the abovementioned control means comprise electric switch means, connected in series between one electric connection of the thermoelectric generator, i.e. the thermocouple 8, and the solenoid of the safety valve.

In the currently preferred version, the abovementioned timing means include a circuit arrangement, particularly an electronic circuit, indicated in its entirety with 13 on FIGS. 2 and 3. In the example, such circuit arrangement 13 comprises a printed circuit board or PCB, indicated with 13*a*, mounted on which are the circuit components, some of which indicated with 13*b*. In the preferred, though not exclusive, embodiment of the invention, the circuit arrangement is also conceived with the aim of controlling the ignition system S+, S− of the flame on the burner 9.

The circuit which obtains the timing function is obtainable through any known method, and thus it shall not be described in detail herein. Here it suffices to point out that such circuit comprises means for counting time, for example represented by a low cost microcontroller provided with the clock function, and by at least one controllable electrical or electronic device, suitable to be controlled to open or vary the electric circuit of the thermocouple 8, when the ignition time interval of the burner 9 set through the knob 12 expires. In a preferred embodiment, described hereinafter, the abovementioned controllable device is made up of a switch, of the electro-mechanical type (for example a relay) or of the electronic type (for example a mosfet or a triac), controllable to open the electric circuit of the thermocouple 8. According to possible variants, the abovementioned controllable device is configured to vary the electric circuit of the thermocouple 8, and comprise for example a device configured for cutting off or controlling the power supply of the solenoid by short-circuiting the terminals of the thermocouple, or by inserting—in parallel—a load or resistance that reduces the current on the solenoid.

In a possible variant, not represented, the thermocouple 8 is not connected directly to the solenoid SV, or the signal of the thermocouple is detected by an electronic circuit configured for controlling—consequently—the solenoid; such circuit may be part of the device according to the invention, which detects the signal of the thermocouple and processes it as a function of the set time, then controlling the solenoid.

Also the circuit part related to the ignition system S+, S− may be obtained in any known manner, and integrated at least partly in the circuit arrangement 13, in particular, providing for—in such arrangement—at least one device or control element of the ignition system.

Figure 5:
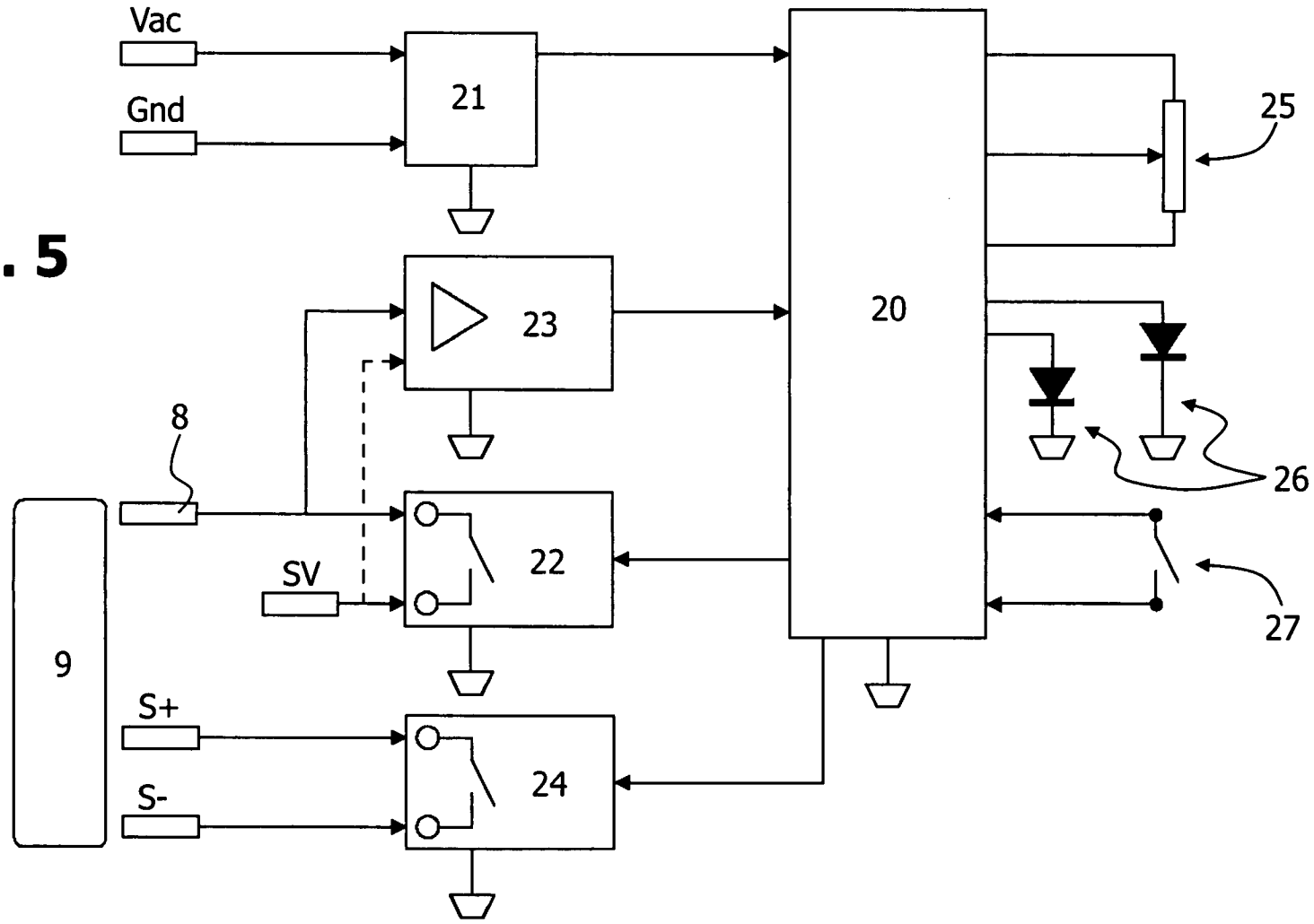
FIG. 5 is a simplified circuit diagram of the control device of FIGS. 1-4.
Figure 7:
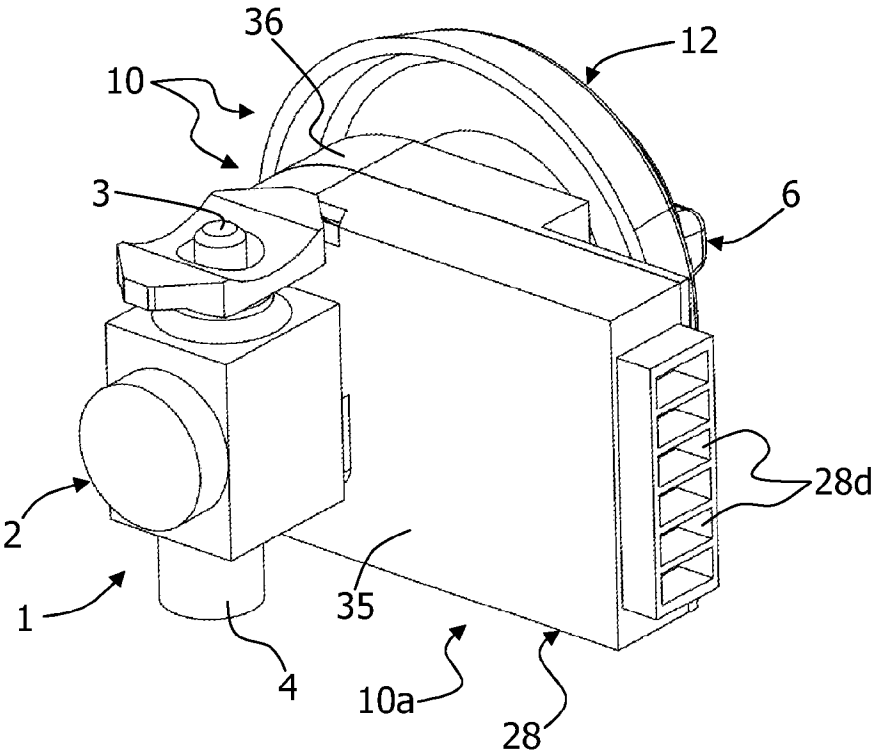
FIGS. 6 and 7 are schematic perspective views, from different angles, of a gas tap or valve with a control device associated according to a second embodiment of the present invention.
Figure 6:
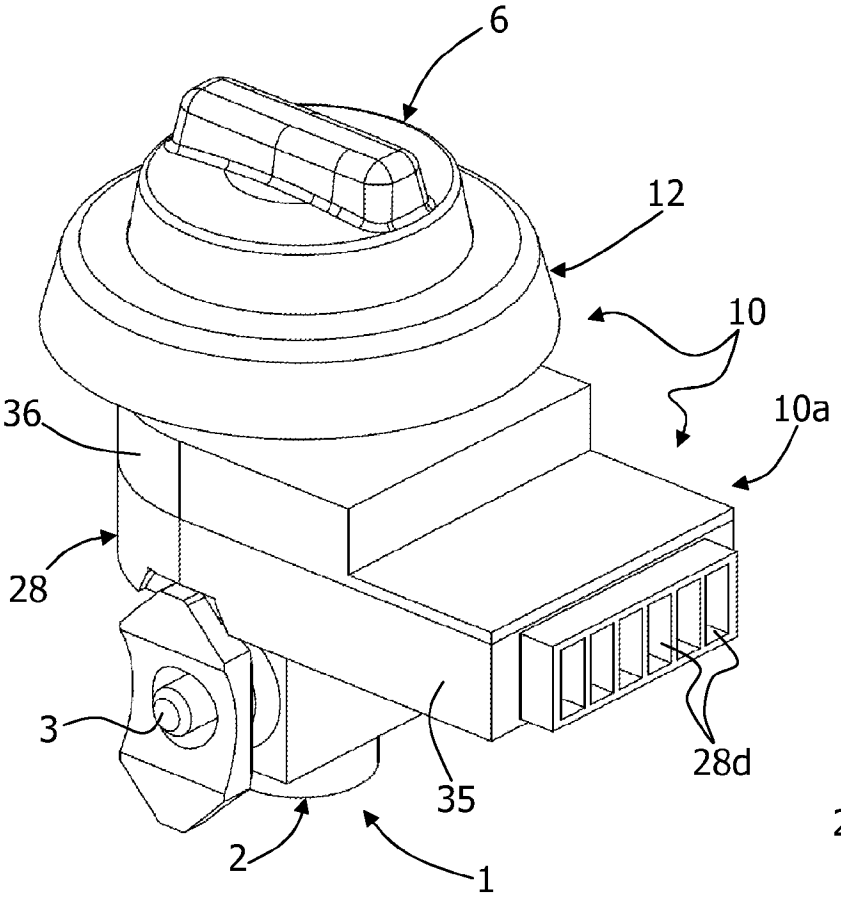

Represented in FIG. 5 is a possible simple diagram of the circuit arrangement 13 of the control device according to the invention. In such FIG. 5, indicated with 20 is a circuit configured for controlling at least the timing, for example made up of a commercial microcontroller, which is supplied with low direct voltage (for example (3-12 Vdc) through a stabilized power supply stage indicated with 21, conceived in a known manner. The stage 21 receives electric voltage in direct current from the power supply system, or from another electrical power generator of the apparatus, whose positive and ground poles are indicated with +Vac and GND, respectively.

Indicated with 8 and SV are the abovementioned thermocouple and the aforementioned solenoid of the safety valve of the tap 1, or at least two respective points of connection that are connected together in series, with the interposition of the abovementioned controllable device, herein represented for exemplifying and non-limiting purposes by a switch 22, such as a relay or a mosfet. The switch 22, preferably but not necessarily of the normally open type, is switchable through a pulse or signal commanded by the timing circuit 20.

Preferably connected to the circuit of the thermocouple 8 and/or of the solenoid SV is a sensor 23, such as a current sensor, for example made up of a shunt resistor in series on the circuit and on the tips of which the electric voltage is detected, proportional to the circulating electric current (according to a possible variant, described hereinafter, the sensor 23 may be a voltage sensor).

Indicated with S+ and S− are the aforementioned electric terminals of the gas ignition system, including the electrodes generated between which is the spark suitable to ignite the gas on the burner 9.

The two terminals S+ and S− are connected in series through a further controllable electric or electronic device, herein represented for exemplifying and non-limiting purposes by a switch 24, such as a relay or a mosfet, or another switch or electronic control element.

Also the switch 24, preferably of the normally open type, is switchable through a pulse or signal generated by the circuit 20, which is preferably configured also with the aim of controlling the ignition system.

Indicated with 25 are sensor means suitable to detect the position, among a plurality of possible positions, acquired by a manual command means of the timing circuit 20 and/or of the control device 10, and in particular the angular position of the knob 12. Such sensor means, which—in the represented example—consist of a potentiometer sensor, are connected to the circuit 20, so as to provide the latter with information regarding the angular position of the knob 12, and thus the duration of the time interval set through the 1*a* knob itself.

In FIGS. 2 and 3 the sensor means 25, represented solely schematically, are made up of a rotary potentiometer conceived in a per se known manner, having a component 25*a* which is rotated with the knob 12, bearing a contact sliding on a component 25*b* mounted on the PCB 13*a*. It shall be observed that the means for sensing the angular position of the knob may be of a type different from the exemplified one, and also comprise sensors without contact, such as a sensor of the magnetic or optical or inductive or capacitive type, as described hereinafter regarding possible variants of the invention.

Still in FIG. 5, indicated with 26 are signalling means, consisting of two light sources, for example light emission diodes, or LEDs, suitable to generate—under the control of the circuit 20—light signals useful for the user of the device 10, as described hereinafter; additionally or alternatively, the device according to the invention may be provided with display or signal means of another type, even of the acoustic type.

Indicated with 27 is a command element, used for providing a command signal for activating the timing circuit 20 and/or the counting of time by the circuit 20, as described hereinafter.

In the illustrated non-limiting example, the command element 27 is represented by a switch, including two contacts indicated with 27*a* and 27*b* in FIGS. 2 and 3. Furthermore, in the represented implementation, the same command element or switch 27 is used to provide a command signal to the gas igniter S+, S−.

In a possible embodiment, the element 27 provides the circuit 20 with a command signal, which is then managed by the circuit itself also taking into account other status signals, such as the signal generated by the sensor 23 and by the sensor means 25. Should the circuit 20 be of the microcontroller type, like in the preferred embodiment of the invention, the command signal and other status signals are also processed according to the program memorised in the circuit 20, for example according to complex or smart functions, or according to predefined algorithms; on the contrary, should the circuit 20 be an analog circuit or have simplified digital logic, the signals shall for example be correlated to determine the start or non-start of a predefined counting of the time. In other words, regardless of the type of processing selected, the element 27 provides a generic command or activation signal for the circuit 20; however, regardless of whether the time counting start is delayed by other factors. Thus, generally, the activation command provided through the element 27 determines an event, which causes a further event or a processing by the device 10.

Figure 4:
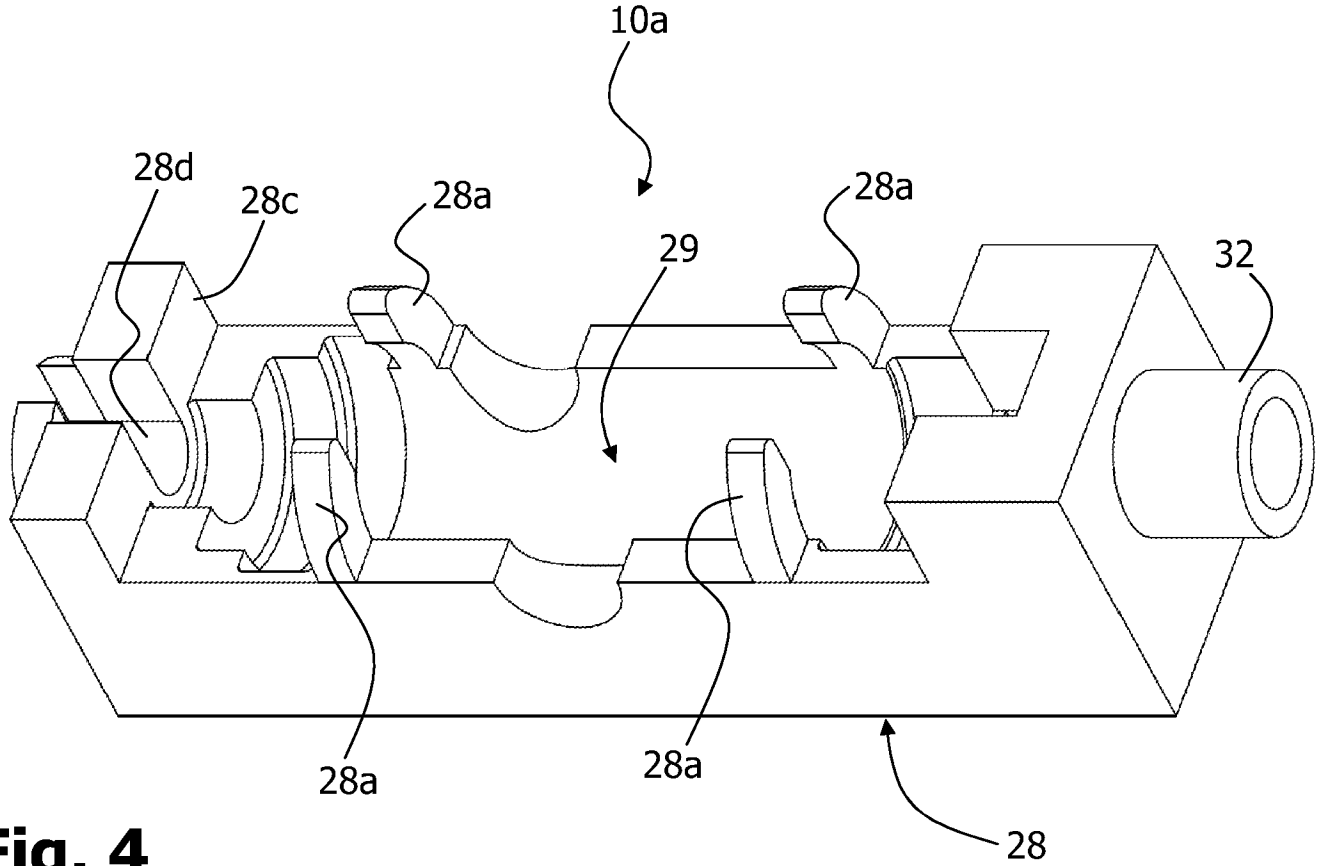
FIG. 4 is a schematic perspective view of a functional unit of the control device of FIGS. 1-3.

In FIG. 4 indicated with 28 is the body of the functional unit 10*a* of the device 10, housed in which is the circuit arrangement 13. As observable, preferably obtained in the body 28 are coupling means 28*a*, which allow coupling the body 28 to the tap body 2. In the example, these coupling means are configured as elastic hooks, which allow a substantially snap or quick coupling between the bodies 28 and 2, but obviously, the configuration of such means may be different. In the example, the body 28, made—at least partly—of insulating material, such a moulded thermoplastic material, defines a seat or blind cavity 29, configured for housing—at least partly—the tap body 2: thus, the body 28 may be fitted laterally onto the body 2; for this purpose, provided for at the proximal end of the body 28 is a body portion 28*b* having a groove or slit 28*c*, which receives a tubular portion 12*a* of the knob 12 therein, passing through which is a portion of the manoeuvring shaft 5 of the tap 1. The cavity 29 preferably has a profile matching, particularly substantially complementary, to that of the part of the body 2 received therein.

Clearly observable in FIGS. 2 and 3 is the manoeuvring shaft 5, keyed onto which is the knob 6 of the tap 1. Positioned coaxially with respect to the knob 6, between the latter and the structure 7, is the knob 12 of the device 10, the knob 12 having the abovementioned tubular portion 12*a* in which the shaft 5 is received, with possibility of relative rotation and sliding. In the illustrated example, associated to the tubular portion 12*a* is the moveable component 25*a* of the potentiometer 25. As mentioned, the angular position of the knob 12 may also be detected through sensor means different from the exemplified ones, even without a sliding contact.

Mounted on the shaft 5 is an actuation element 30; this element 30 may be constrained to the shaft 5 or be mounted sliding freely thereon, countering the action of an elastic element, such as a spiral spring 31, like in the shown example. The arrangement is such that, by pressing the knob 6, and thus moving the knob 12, or pressing the knob 12 alone, the tubular portion 12*a* causes the sliding of the actuation element 30 on the shaft 5, hence determining the switching or closing of the command element 27, herein represented by the two plate contacts 27*a*-27*b*, as observable in FIG. 3 (analogously to the description outlined referring to the components 25*a* and 25*b*, the essentially mechanical unit made up of elements 30 and 27 could be of another type, for example magnetic or optical or inductive or capacitive; or it could be a contact that varies an electric resistance following pressure applied thereon).

Releasing the knob 6 or 12 causes returning to the position of FIG. 2, wherein the command element or switch 27 is open, i.e. it does not generate the respective position or control signal.

With the aim of setting the desired ignition time interval of the burner 9 the user is first required to rotate or position the knob 12 to set the desired time, for example variable between 1 and 120 minutes. Subsequently, the user rotates the knob 6 and presses it, to produce the initial opening of the safety valve and the activation of the gas igniter. Pressing the knob 6 also causes the pressing of the knob 12, with the ensuing switching of the control element 27 which, as mentioned, serves to generate a command signal for the circuit 20 of FIG. 5, in particular to activate the timing system and the ignition system S+, S−.

The circuit of FIG. 5 is preferably configured to guarantee low consumption in the respective stand-by condition and is "woken-up" by the switching of the command element 27. Following such switching, the circuit 20:

acquires from the sensor 25 the information regarding the angular position of the knob 12, from which the circuit itself obtains the information regarding the duration of the ignition time interval of the burner 9 and/or of the time of consent to activation of the solenoid SV (it should be observed that the ignition time of the burner does not necessarily precisely correspond to the activation time of the solenoid, the two times possibly having a few seconds difference, considering that the burner ignition command 24 and the solenoid activation command 22 are independent from each other and that the burner and solenoid are not necessarily activated simultaneously; as a matter of fact, the solenoid could be activated first, to start the flow of the gas, and after one second, the ignition spark is generated);

commands the closure of the switch 22, which thus connects the thermocouple 8 to the winding of the solenoid SV of the safety valve; the switch 22 is kept at the closed condition;

commands the closure of the switch 24, with the ensuing generation between the electrodes connected to the terminals S+, S−, of the spark which causes the ignition of the flame; after the pulse, the switch 24 is reopened;

after a short wake-up time interval, it monitors—through the sensor 23—the presence of current, indicating the closure of the electric circuit and the ensuing activation of the solenoid SV, and starts the countdown of the time interval set by means of the knob 12 (as mentioned, the sensor 23 could be a voltage sensor: in such case, the sensor 23 monitors the presence of voltage generated by the thermocouple 8, indicating the actual ignition of the flame on the burner 9, and hence the actuation of the solenoid SV).

As mentioned, the heat generated by the flame has the consequence lying in the fact that the sensitive part 8*a* of the thermocouple generates the current required to keep the safety valve open, given the closed condition of the switch 22. In such condition, the sensor 23 detects the presence of the current (or voltage) generated by the thermocouple 8, and the respective signal is acquired by the circuit 20.

The detection performed by the sensor 23 may also advantageously be exploited to start the counting of the time solely starting from the actual ignition of the burner 9, and not from when the knob 12 is pressed while the burner is not yet ON (this may be the case, for example, of a user trying to ignite the burner in vain, maybe waiting over a period of time before trying again; in such case, and based only on the switching of the switch 27, the counting of the time would start at the first attempt, with a counting error equivalent to said period of time between the ignition attempts). Considering a normally open switch 22, upon switching the switch 27 the timing circuit closes the witch 22, to allow the activation of the solenoid SV by the thermocouple 8; however, if the sensor is not ignited, or if the sensor 23 does not detect the ignition within a given period of time, then the circuit is reset, while in the opposite case the time counting starts from the actual time of ignition. By contrast, in the case of a normally closed switch 22, the step of initial activation of the same switch is not required, starting the time counting solely upon the detection of the signal of the sensor 23, indicating the ignition of the flame.

In the normal operation, at the end of the time interval set through the knob 12, the circuit 20 generates a signal or pulse for switching the switch 22, causing opening thereof. In such manner, the thermocouple 8—solenoid SV circuit is open, with the ensuing closure of the safety valve of the tap 1: the burner 9 thus goes OFF upon reaching the preset time.

The device 10, or the tap and the respective burner may be reutilised immediately, for example for further coking operations; alternatively, the circuit 20 returns to the stand-by condition, or awaiting a new time setting and the respective activation command through the switch 27, only after the elapse of a period of time determined by the flame going OFF.

In an embodiment of the invention, the functional unit 10*a* is advantageously configured to facilitate quick connection between the module itself and the thermocouple. For such purpose, in the example shown in FIGS. 2 and 3, the body 28 of the unit 10*a* has, at the distal end, a connector element, such as a tubular component 32, made of electrically conductive material, for example metal, threaded externally or however equipped with an electrical and/or mechanical coupling with an end connection element 8*b* of the thermocouple 8, such element 8*b* preferably being of the standard type, for example in form of an internally threaded bushing. The body 28 of the unit 10 may be possibly moulded or over-moulded on the component 32.

In the example, the unit 10*a* is also provided with electric contacts aimed at allowing a quick electric connection between the electric parts of the unit 10*a*, and in particular at least the switch 22, the solenoid of the safety valve and the thermocouple.

For such purpose, indicated with 33*a* and 33*b* are two ground contacts, associated to the circuit 13, arranged for connecting the component 32 (and thus the ground conductor 8' of the thermocouple 8) to the tap body 2 (and thus to the ground of the solenoid).

Indicated with 34*a* and 34*b* are two further contacts, which are respectively coupled to the phase terminal of the solenoid, indicated with SV', projecting from the distal end of the body of the tap 2, and the central conductor 8" of the thermocouple 8. As observable, in the represented example, connected in series between the two contacts 34*a*-34*b* is the switch 22 (as a non-illustrated variant, interposed between the terminals 33*a* and 33*b* could be a controllable device or switch or a commanded element analogous to that indicated with 22).

As evincible, through this arrangement, the body 28 of the unit 10*a* may be fitted onto the tap body 2, thus obtaining the connection of the contacts 33*b* and 34*b* to the tap body 2 and to the terminal SV' of the solenoid, respectively. Then, the bushing 8*b* is screwed onto the bottom of the component 23, hence also obtaining the electric connection of the conductors 8' and 8" of the thermocouple 8.

In the exemplified embodiment, the various contacts 33*a*-33*b* and 34*a*-34*b* are configured as plate contacts, projecting from the board 13*a* towards the interior of the cavity 29 of the body 28 of the unit 10*a*, into which the tap 1 is coupled. Obviously, the abovementioned contacts could be shaped or configured in a manner different from the illustrated one.

Illustrated in FIGS. 6-10 is a second embodiment of the invention. In such figures the same reference numbers of the previous figures are used to indicate elements technically equivalent to those already described previously.

In this embodiment the knob 12 is not suitable to slide axially, but is free to rotate, and associated to the manoeuvring shaft 5 of the tap 1—represented solely partly and with configuration of the body 2 different with respect to the first embodiment—is an actuation element 30', which essentially serves the functions of the element 30 of the first embodiment. The element 30' is coupled to the shaft 5 in such a manner to allow the free rotation of the latter, and so that pressing the knob 6 causes an axial displacement of the element itself, with the ensuing closure of a contact or control element, indicated with 27' solely in FIG. 10, substantially serving the functions of the command or switch element 27 of the first embodiment.

In this case, the functional unit 10*a* includes a first module or portion 35, which houses the circuit arrangement 13, including the circuit 20, and a second module or portion 36, which houses sensor or control means 25 (FIG. 10), to indicate the angular position of the knob 12.

Figure 9:
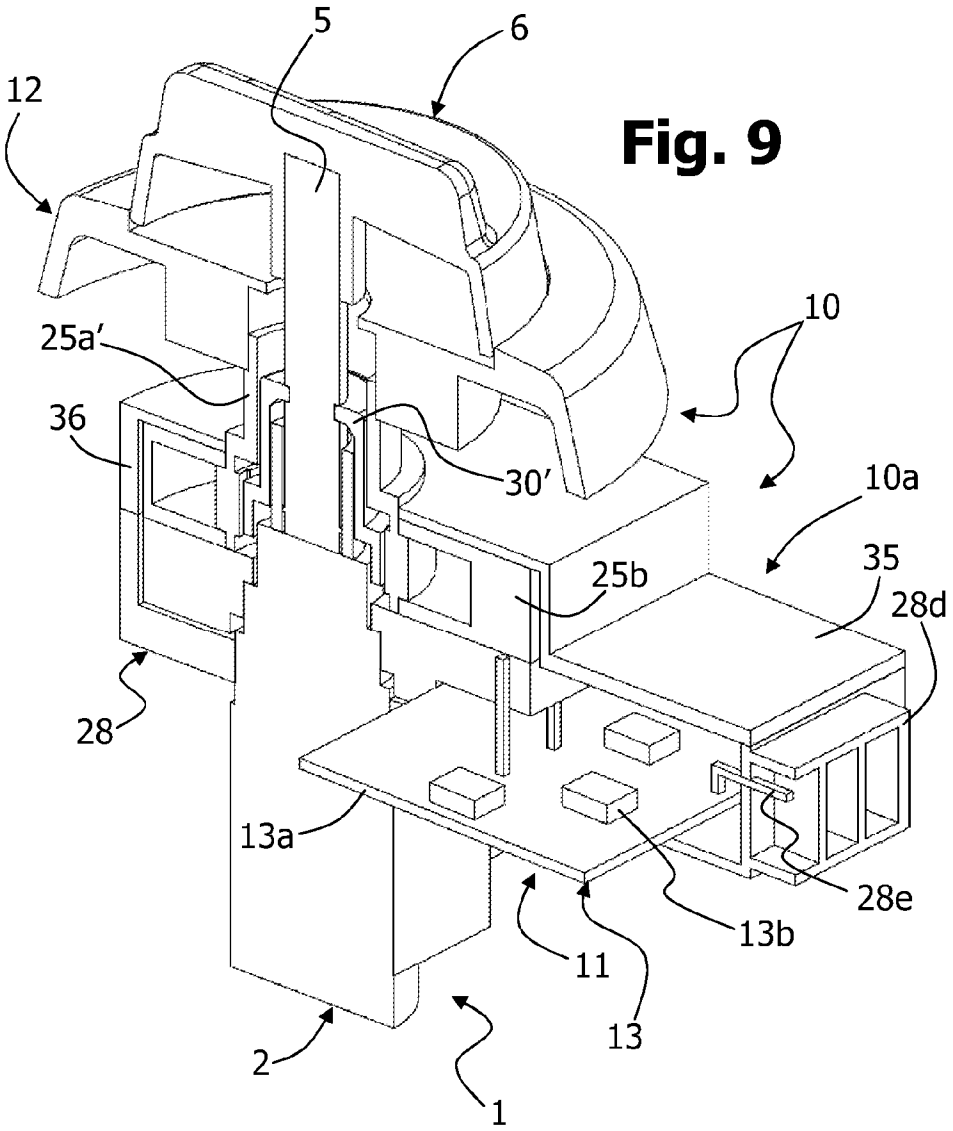
FIG. 9 is a schematic sectional view of the gas tap and of the control device of FIGS. 6-8.

As observable particularly in FIG. 9, associated to the knob 12 in this case is a tubular body 25*a*', coaxial to the shaft 5 and of the element 30', which provides the moveable part of the abovementioned sensor means 25, which is suitable to rotate with the knob, hence energizing the stationary part 25*b* of the sensor means 25.

Figure 8:
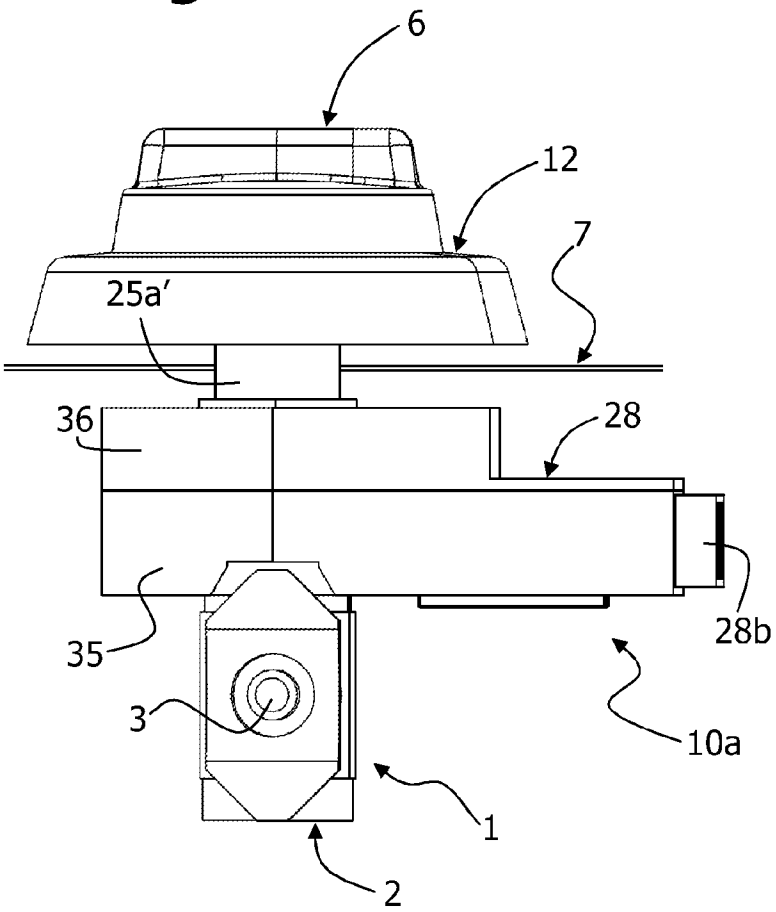
FIG. 8 is a side elevation schematic view of the gas tap and of the control device of FIGS. 6 and 7.

Also in this embodiment, as observable in FIG. 8, in the assembled condition of the tap 1 and of the device 10, the tap body 2 is substantially housed or mainly housed in the structure 7 of the apparatus, with the knobs 6 and 12 instead being operable from outside the structure 7.

The functional unit 10*a* is herein mounted axially on the tap body 2, mainly inside the structure 7, and is configured to be coupled to such body 2; in the example, the unit has a through opening, coaxial to the tubular body 25*a*', into which the proximal end of the tap body 2 is fitted. The shape of the abovementioned through opening may be configured to allow planting—with interference—the body 28 of the unit onto the tap body 2, or provided for may be means for mutual coupling, for example in form of snap-hooks and/or elastic hooks. As in the case of the first embodiment, at least part of the body 28 of the unit 10*a* of FIGS. 6-9 may be over-moulded onto the tap body 2.

In this embodiment, the body 28 of the unit 10*a* is configured in such a manner to have a portion 28*d* that obtains a sort of electric connector, i.e. it includes a series of electric connections outwards, obtained for example through plate contacts, or of the faston or pin type, as schematically represented in FIG. 9, where a pin is indicated with 28*e*. Another possibility lies in providing for insulator perforation contacting means, such as for example of the type commonly used on the so-called catenaries for the ignition systems currently used on gas taps for cooking apparatus.

Figure 10:
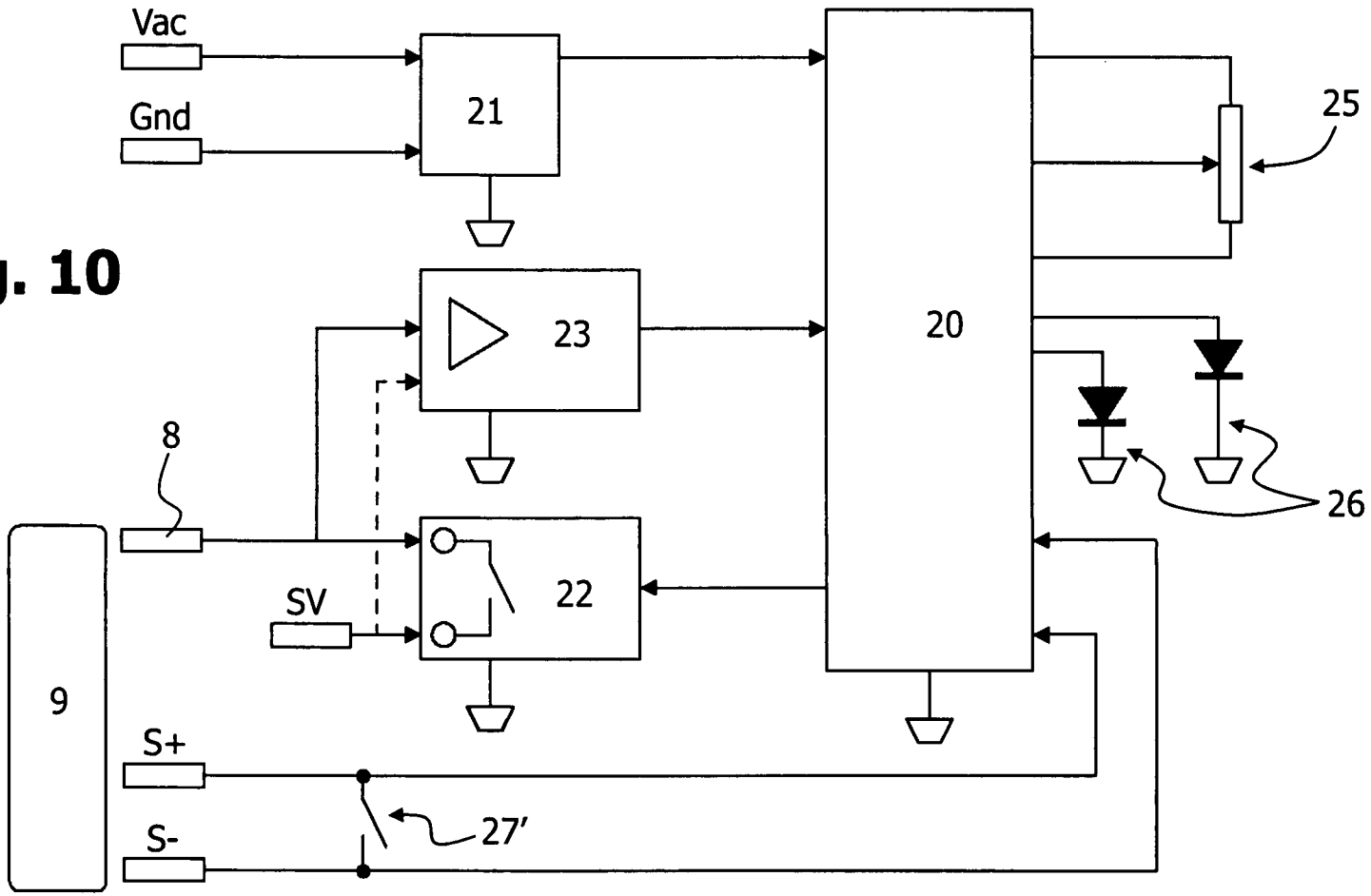
FIG. 10 is a simplified circuit diagram of the control device of FIGS. 6-9.

Illustrated in FIG. 10 is a possible electrical diagram of the device 10 according to the second embodiment, which is mostly similar to that of FIG. 5. The only considerable difference lies in the fact that provided for in this case is only one controllable device or switch 22, which serves the functions described beforehand, while the functions of the controllable device or switch 24 of FIG. 5 in this case are directly performed by the command element or switch 27' which, as outlined, in the second embodiment is directly commanded by the actuation element 30' of FIG. 9, associated to the manoeuvring shaft 5 of the tap; in such example, the command element or switch 27' is connected in parallel both to the terminals S+, S− of the ignition module, and to the timing module 20.

The operation of the device 10 of FIGS. 6-10 is substantially similar to that described with reference to the first embodiment. The knob 12 is rotated to the desired position, with the aim of setting the ignition time of the burner 9. Then, the knob 6 is slightly rotated and then pressed: this allows causing the initial opening of the safety valve, the energising of the ignition system S+, S−, the closure of the switch 22 and the start of the time counting.

Regardless of the selected embodiment, the device 10 according to the invention preferably has a predefined non-intervention position, so as to allow the normal use of the tap 1 and the respective burner 9 without activating the timing function. Such position may be conveniently represented by a "zero" angular position of the knob 12. When the knob 12 is in such position, detected through the sensor means 25, the functionalities of the circuit 13 associated to time counting, and thus to the control of the switch 22, shall not be active. Possibly provided for in such "zero" position is the presence of mechanical lock elements, for the knob 12 and/or for at least some activation and/or control means, such as for example the contact 27; for example, in the abovementioned zero position, the knob 12 may be mechanically locked, in such a manner not to be pressed towards the element 27, or the switching of the element 27 alone is hindered (for example through an insulation tab which is interposed between the two contacts 27*a*, 27*b*), without locking the movement of the knob 12.

Upon the ignition of the burner 9 the circuit 20 shall however command the switching of the switch 22, so as to guarantee electrical continuity between the thermocouple 8 and the solenoid of the safety valve. As already mentioned, in possible circuit variants, the switch 22 could be of the normally closed type, for example made up of a relay of such type.

As mentioned previously, the circuit 20 may control one or more signalling means (whether sources of light and/or displays and/or acoustic signallers), which in the circuit examples of FIGS. 5 and 10 are represented by light emitting diodes 26. Provided for in the considered example are two diodes, preferably provided for generating light of a different colour, but obviously provided for may be even only one two-colour or one-colour source, or numerical or alphanumerical or graphical displays. The signalling means are conveniently used for signalling to the user the status of the timing function, when activated, for example generating a blinking green light, with an increasing frequency approaching the expiry of the set time interval, and generating a fixed red light at the end of the cycle. The circuit 20 may be configured in such a manner that, upon completion of a given period of time from the gas going OFF, the source of light indicating the end of cycle is switched off; additionally or alternatively, the switching off of such source may be actuated manually, returning the knob 12 to the respective zero position.

In an embodiment, the diodes 26 are mounted on the module 36, for example in form of an angular sensor or potentiometer equipped with one or more LEDs of this type; through light guides, the generated light signal may be brought to determined zones of the knob 12; light guides of this type may be incorporated or obtained in the body of the knob 12 and of the element 12*a* or 25*a*' associated thereto. Advantageously, the entire body or at least part of the knob 12 and of the tubular element 12*a* may be made of material such to transmit and/or spread the light generated by such means 26.

In an embodiment, the control device is prearranged for signalling with a certain advance (for example two minutes) elapsing of the set time interval; also in this case, signalling can be a visual one (for example by means of a light source) and/or an acoustic one (for example by means of a buzzer).

In an embodiment, associated to the device 10 according to the invention are autonomous supply means, aimed at guaranteeing the timing function even in absence of electrical power supply. These supply means may for example comprise a known buffer battery, preferably fitted in a zone easily accessible to the user.

In a particularly advantageous variant, such power supply means comprise a thermoelectric generator, which may be made up of second thermocouple, or by a double or multiple thermocouple, with at least three conductors, used, alternatively with respect to the one previously indicated with 8, both for supplying the power which supplies the solenoid to keep the safety valve in the respective open condition, and for providing a voltage for supplying power to the circuit 13.

Given that the voltage generated by a thermocouple is usually low (a few hundreds of millivolts), this voltage may be advantageously increased by using a voltage booster circuit of the known type, to a value suitable to guarantee the supply of the control circuit and the respective devices or controllable switches, which shall preferably consist of low consumption electronic switches. Voltage booster circuits of this type, in form of integrated circuits, are for example those of the S-882Z series produced and sold by Seiko Instruments Inc., to whose technical documents reference shall be made for further details (see for example the following Internet address: http://www.sii.co.jp/info/eg/soil.html).

For the possible use of electronic switch means, such as relays, low consumption solutions may be used, such as for example using bistable relays or relays that require a high voltage pulse for the closure and a low consumption pulse in maintenance (i.e. substantially with a type of operation similar to that of the solenoid of the safety valve of the tap).

In the preferred embodiment, the device 10 according to the invention is conceived to allow the user to vary the period of time for opening the safety valve subsequently to the initial setting (i.e. even after the burner 9 has already been switched ON), for example when the user in question thinks otherwise or realises that the cooking is not yet complete in proximity to the expiry time interval set initially.

For such purpose, associated to the knob 12 may be known mechanical stop means (for example in form of notches) which hinder rotation, unless when pressed and/or the circuit 10 may be configured in such a manner that a pressure on the knob 12 subsequent to the initial one (i.e. the one that determines the starting of the time counting) is interpreted by the circuit itself as a reset command, or as a command for restoring or modifying the set time In the previously exemplified embodiments associated to a contact or switch are both the activation of the ignition system S+, S−, and the functionalities of the device 10 connected to the timing. Provided for in other embodiments—not represented—are two separate contacts or switches, one operable through the axial displacement of the knob 6 and the other through the axial displacement of the knob 12. Such solution may be used for obtaining the device 10 when this is intended to be maintained distinct from the circuit which manages the operation of the ignition system. Thus, for such purpose, a contact may be associated to the manoeuvring shaft 5 of the tap 1 (to command the ignition system) and another contact associated directly or indirectly to the knob 12 for setting the time interval. In such embodiment, preferably, the two knobs 6 and 12 are mounted in such a manner that the pressing of the knob 6 also causes the pressing of the knob 12. In addition, such embodiment it is also clearly possible to provide command pulses to the timing circuit solely by pressing the knob 12, i.e. not requiring the activation of the ignition system too.

In the previously outlined embodiments, the timing and the functionalities associated thereto, are obtained by means of a circuit arrangement. However, it shall be observed that the basic characteristics of the invention, i.e. those of having a timing unit associated to the body of the tap, may also be implemented through a mechanical or electromechanical mechanism, obtainable through per se known technology. In such embodiment, the abovementioned mechanism is however part of a unit mainly associated to the gas tap and conceived to control an electric contact or switch, preferably in series in the thermocouple-solenoid circuit of the safety valve, according to the description outlined beforehand.

In such variant, for example, the initial setting of the time interval for activating the burner determines the closure of the abovementioned contact and, at the expiry of the interval, the same mechanism causes the opening of the contact, and thus of the thermocouple-solenoid circuit, with the ensuing interruption of the flow of the gas to the burner. Advantageously, such mechanical or electromechanical timer may be conceived to also determine the automatic repositioning of the manoeuvring shaft of the tap, and hence of the respective knob, at the angular position corresponding to the closed condition of the tap.

Characteristics and advantages of the present invention are clear from the description outlined above. The described device has a simple structure, is small in size, easy to mount, and safe to use. The device is also versatile in use given that it may be structurally conceived to be mounted on traditional taps, without modifying the latter.

The invention finds preferable application in the domestic appliances industry for cooking, such as cooking hobs, ovens, cookers, but it shall be observed that the described control device is suitable for use in other types of apparatus, in which a gas burner is controlled through a respective tap, such as for example boilers for household systems or wall-mounted boilers in buildings, for example as a safety function for switching OFF after a preset period of time.

It is clear that the device described as an example may be subjected—by a man skilled in the art—to various variants without departing from the scope of protection of the invention as defined by the attached claims. Variants, components and solutions described previously with reference to an implementation or embodiment may be combined and/or interchanged with variants, components and solutions described previously with reference to a different implementation or embodiment, also for obtaining devices different from those exemplified herein.

According to a possible variant, the circuit of the device according to the invention is configured for interfacing with, and for transmitting information to, an external display module; such display module may be optional, i.e. it may be mounted or not mounted on the apparatus provided with at least one tap having a control device according to the invention associated.

In such an embodiment, the abovementioned module receives signals from the control device 10, particularly information regarding the passing of time from the start of the ignition of the respective burner, and possibly other information useful to the user, such as information related to status or malfunction. Obviously, when several control devices 10 are connected to the display module, the time of each device 10 may be displayed on a single display belonging to the abovementioned module. The display of times may be commanded in various manners, for example by pressing command means provided for on the display module (for example a respective button), or by pressing—briefly—one of the knobs 6, 12. For connection purposes, the circuit of each device 10 is equipped with an electric connection (such as a small connector obtained from a PCB with two terminals) for transmitting or receiving data (time, display signal, status signal, etc) with respect to the display module, preferably transmission and/or reception of serial data.

The communication format or protocol between the device 10 and the display module (and/or with a possible further peripheral circuit connected to the device 10, such as a gas sensor) may be of any type; not necessarily serial; likewise, the connection may be wired or wireless.

Figure 11:
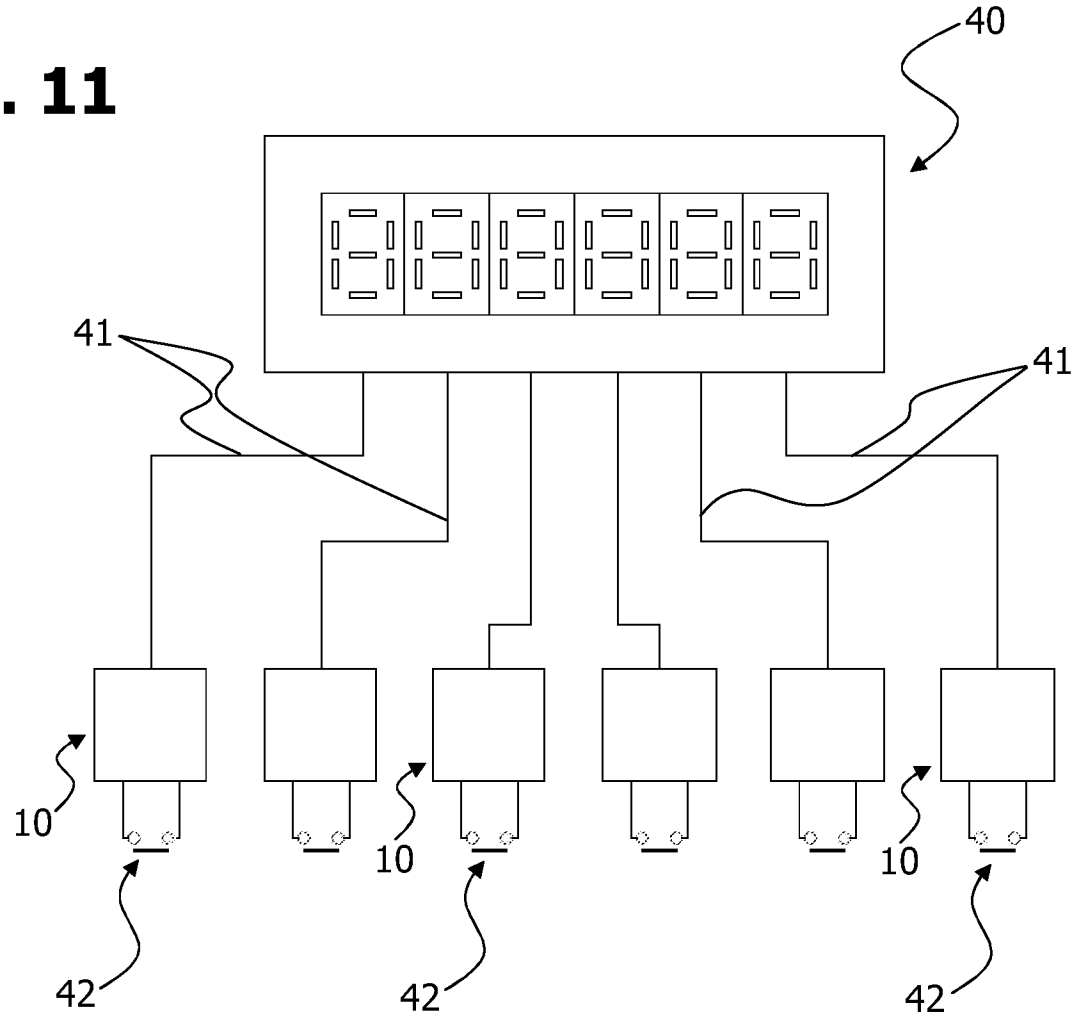
FIG. 11 is a schematic representation of a variant of the invention.

A schematic example of the abovementioned display module is represented in FIG. 11, where the display module is indicated with 40 and connected to a data line 41 to respective devices 10, represented solely schematically, and where the contact 42 associated to the knob of the tap or of the device 10 (may also be the same contact 27 or 27' of the previous figures) enables the display.

Though being an optional element, the display module according to the proposed variant allows producing devices 10 with simplified basic structure and thus low cost. As a matter of fact, the devices 10 may always be the same (low cost standard product), and useable or non-useable in combination with an additional display module 40, depending on the requirements. Such solution also allows obtaining the device 10 and the display module 40 with components having different characteristics or resistance to operative temperatures.

The circuit characteristics and/or configurations described referring to a display module may be advantageously provided for other circuits or modules connectable to the device 10, such as a circuit sensor (for example for gas), where data, such as values detected by the sensor module and/or respective commands or operating status are transmitted and/or received on the communication line, whether wired or wireless.

In a further possible variant, at least a part of the control electronic means of the device according to the invention is housed in the knob of the device itself, and is in signal communication with the remaining part of the electronic means, housed in the functional unit 10*a*; the connection between the two circuit parts is obtainable for example through a radiofrequency connection or wired connection, using conductors that rotate with the knob 12 or with rotating/sliding contacts.

The previously described embodiments refer to the application of the invention with taps conceived traditionally, wherein the actuation shaft is rotatable and translatable axially. However, the principles of the invention may also be applied to taps with different actuation and/or control movements, for example in gas taps or valves whose knob is also slightly inclinable or moveable laterally, with a joystick-type movement, such movement being exploited, according to the principles of the invention, for example for selecting the desired ignition times of the burner, or for providing other commands to the control device. In other variant embodiments, the command means 12 may consist, instead of a rotary knob, of one or more buttons (for example a "+" button and a "−" button, for setting the time) or by a sensor which detects the commands by the user (such as touch sensitive commands).

In the description according to the circuit diagrams of FIGS. 5 and 10, the sensor 23 is a current sensor, but as explained the same functionalities may also be obtained using a voltage sensor, for example connected in such a manner to detect the voltage at the tips of the solenoid; such case is exemplified, in FIGS. 5 and 10, by the dashed line between the connection of the solenoid SV and the sensor 23.

As mentioned previously, the means for sensing the angular position of the knob 12 may be of a type different from the exemplified one, and also comprise encoder sensors and contactless sensors, such as a magnetic or optical or inductive or capacitive sensor. In the case of a magnetic position sensor, associated to the component 25*a* may be a permanent magnet, whose movement and/or variation of magnetic field is detected by a magnetic sensor associated to the component 25*b* or mounted on the PCB 13*a* (such as for example a Hall or magneto-resistive sensor), hence generating a variable signal, for example defining the preset time and/or the control mode. In case of an optical position sensor, associated to the component 25*a* may be an element suitable to cause variations in an optical sensor, for example provided with a series of obscure zones and transparent zones, whose movement of the component 25*a* is detected by an optical sensor associated to the component 25*b* or mounted on the PCB 13*a*, such as for example an optical sensor provided with a light emitter and receiver, where the emission and/or reception of the optical beam is altered by the movement of said moveable element

25*a*, hence generating a signal, for example indicating the predefined time and/or control mode.

In case of an inductive or capacitive position sensor, associated to the component 25*a* may be an element whose movement causes a variation detectable by a inductive or capacitive sensor associated to the component 25*b*, generating said signal.

The same concepts described above may also be applied to the essentially mechanical unit made up of elements 30 and 27 or 30' and 27', which could include or be made up of a magnetic or optical or inductive or capacitive switch or sensor, or any other type of sensor or encoder, or it may be a contact which varies an electric resistance following application of a pressure thereon. In such case, associated to the actuation element 30 or 30' may be a permanent magnet, whose movement and/or variation of a magnetic field is detected by a magnetic sensor analogous to the one just described above, which obtains the command element 27 or 27', hence generating a signal, particularly indicating the axial position and status of the knob 6 and/or 12, or an element suitable to cause variations in an optical sensor, where the movement of the actuation element 30 or 30' is detected by an optical sensor analogous to the one just described above obtaining a command element 27 or 27', where the transmission and/or reception of the optical beam is altered by the movement of said actuation element 30 or 30', hence generating said signal, or an element whose movement causes a variation detectable by an inductive or capacitive sensor obtaining the command element 27 or 27', generating said signal.

The various characteristics and examples may be combined—at least partly—with each other, to obtain devices even different from those illustrated and outlined for exemplifying and non-limiting purposes.

The invention claimed is:

1. A gas supply control device for a gas tap having a safety solenoid valve for a cooking or heating apparatus, the gas supply control device including a timing device;

a command arrangement operable for manually setting a time interval of opening of the safety solenoid valve of the gas tap;

a control element, controllable by the timing device;

wherein the gas supply control device is prearranged for use in combination with a gas tap body which includes the safety solenoid valve wherein a solenoid of the safety solenoid valve is configured for electrical connection to a thermoelectric generator designed to generate, in response to heat generated by a flame, an electric current for supplying said solenoid and keeping as a consequence the safety solenoid valve in a respective open condition, wherein the control element is electrically connected between said thermoelectric generator and said solenoid in such a way that, with the control element in a first condition, the electric current generated by the thermoelectric generator reaches the solenoid to keep the safety solenoid valve in said open condition and, with the control element in a second condition, the electric current generated by the thermoelectric generator is interrupted or reduced before reaching the solenoid, thereby causing the safety solenoid valve to pass in a respective closed condition, wherein the timing device, the control element and the command arrangement belong to a control circuit prearranged for electrical coupling with said solenoid, at least one of the timing device and the control element belonging to one functional unit prearranged for mechanical coupling with a portion of the gas tap body which, in an installed condition, is within a housing structure of the apparatus, and wherein the control element is controllable by the timing device to assume said second condition at the end of the time interval set through the command arrangement, for causing an interruption or a reduction of the electric current generated by the thermoelectric generator for supplying said solenoid.

2. The gas supply control device according to claim 1, wherein the command arrangement comprises a manually operable command element for manually setting said time interval.

3. The gas supply control device according to claim 2, wherein the timing device is configured for counting said time interval following upon, or in function of, a command for activation of the gas supply control device.

4. The gas supply control device according to claim 3, wherein the gas supply control device is prearranged such that the command for activation is caused following upon displacement of at least one of a command member of the gas tap, a maneuvering shaft of the gas tap and the manually operable command element of the command arrangement.

5. The gas supply control device according to claim 2, wherein the manually operable command element is movable or translatable relative to or along an actuation axis of the gas tap in an independent manner with respect to a command member and/or a maneuvering shaft of the gas tap.

6. The gas supply control device according to claim 1, wherein the functional unit has one housing body configured for mechanical coupling with said portion of the gas tap body.

7. The gas supply control device according to claim 4, comprising a mechanical transmission element, prearranged for coupling to said maneuvering shaft or to said command member of the gas tap and displaceable therewith to cause said command for activation.

8. The gas supply control device according to claim 3, wherein the manually operable command element of the command arrangement is capable of displacing a mechanical transmission element adapted to cause said command for activation.

9. The gas supply control device according to claim 1, wherein the functional unit includes a first electric connector and a second electric connector, for quick connection thereof to said solenoid and said thermoelectric generator, respectively, and the control element is electrically connected between the first electric connector and the second electric connector.

10. The gas supply control device according to claim 1, wherein the control element comprises at least one of a switch, adapted to cause said interruption of the electric current which supplies said solenoid, and a device for varying an electric circuit of said thermoelectric generator or of said solenoid, adapted to cause said reduction of the electric current which supplies said solenoid.

11. The gas supply control device according to claim 1, comprising at least one signaling element, selected from among visual signaling elements and acoustic signaling elements.

12. A cooking or heating gas-supplied apparatus, comprising a gas supply control device according to claim 1, a bearing structure, a gas tap, and a gas burner, wherein the gas tap comprises:

a gas tap body connected in a gas supply line to the gas burner;

a maneuvering shaft which protrudes from the gas tap body and is operable for adjusting a gas flow admitted to the burner, a command member coupled to an end portion of the maneuvering shaft which extends outside the bearing structure of the gas-supplied apparatus, for manually setting the gas flow, and a safety solenoid valve, for allowing or preventing gas inflow to the burner, respectively.

13. The cooking or heating gas-supplied apparatus according to claim 12, wherein at least one of the functional unit and the control element includes a first electric connector and a second electric connector, for quick connection thereof to said solenoid and said thermoelectric generator, respectively, and the control element is connected between the first electric connector and the second electric connector.

14. The gas supply control device according to claim 11, wherein said at least one signaling element is configured for signaling at least one of:

a status of a timing function of the gas supply control device;

approaching of elapsing of the time interval set through the command arrangement of the gas supply control device; and elapsing of the time interval set through the command arrangement of the gas supply control device.

15. The gas supply control device according to claim 11, wherein said at least one signaling element comprises at least one of:

a light source mounted inside a housing body of the functional unit and a light guide to transfer light generated by the light source outside the said housing body of the functional unit; and a numerical or alphanumerical or graphical display device for displaying at least one of information regarding the passing of time, information regarding an operating status of the gas supply control device and information regarding possible malfunctioning of the gas supply control device.

16. The gas supply control device according to claim 11, wherein said at least one signaling element comprises a numerical or alphanumerical or graphical display device and said control circuit is prearranged for wireless transmission and/or reception of data with respect to said display device.

17. The gas supply control device according to claim 2, wherein the command arrangement comprises a sensor device which detects commands by a user, said sensor device being a contactless sensors selected from among magnetic sensors, optical sensors, inductive sensors and capacitive sensors.

18. The gas supply control device according to claim 1, wherein the functional unit has one housing body defining a through-passage and a portion of the gas tap body provided with a maneuvering shaft is set through said through-passage.

19. A gas supply control device for a gas tap having a safety solenoid valve for a cooking or heating apparatus having a housing structure, the gas supply control device including a timing device;

a command arrangement for manually setting a time interval of opening of the safety solenoid valve of the gas tap;

a control element, controllable by the timing device for causing one of an interruption and a reduction of an electric current supply to the safety solenoid valve at the end of a time interval set through the command arrangement;

at least one signaling element;

wherein the gas supply control device is prearranged for use in combination with a gas tap body which includes the safety solenoid valve wherein a solenoid of the safety solenoid valve is configured for electrical connection to a thermoelectric generator designed to generate, in response to heat generated by a flame, an electric current for supplying said solenoid and keeping as a consequence the safety solenoid valve in a respective open condition, wherein the control element comprises one of a switch and a device for varying an electric circuit of one of said thermoelectric generator and solenoid, the control element being electrically connected between said thermoelectric generator and said solenoid in such a way that, with the control element in a first condition, the electric current generated by the thermoelectric generator reaches the solenoid to keep the safety solenoid valve in said open condition and, with the control element in a second condition, the electric current generated by the thermoelectric generator is interrupted or reduced before reaching the solenoid, thereby causing the safety solenoid valve to pass in a respective closed condition, wherein at least one of the timing device and the control element belongs to one functional unit prearranged for mechanical coupling with a portion of the gas tap body which, in an installed condition of the gas supply control device, is within the housing structure of the apparatus, wherein the command arrangement comprises a manually operable command element having at least one portion extending outside the housing structure of the apparatus, wherein said at least one signaling element comprises a light source mounted on said functional unit and a light guide to transfer light generated by the light source to said at least one portion of the manually operable command element of the command arrangement, in such a way that the light generated by the light source is visible outside the housing structure of the apparatus.

20. A gas supply control device for a gas tap having a safety solenoid valve for a cooking or heating apparatus, the gas supply control device including a timing device;

a command arrangement operable for manually setting a time interval of opening of the safety solenoid valve of the gas tap;

a control element, controllable by the timing device for causing one of a an interruption and a reduction of the electric current supply to the safety solenoid valve at the end of a time interval set through the command arrangement;

at least one signaling element, wherein the gas supply control device is prearranged for use in combination with a gas tap body which includes the safety solenoid valve wherein a solenoid of the safety solenoid valve is configured for electrical connection to a thermoelectric generator designed to generate, in response to heat generated by a flame, an electric current for supplying said solenoid and keeping as a consequence the safety solenoid valve in a respective open condition, wherein the control element comprises one of a switch and a device for varying an electric circuit of one of said thermoelectric generator and solenoid, the control element being electrically connected between said thermoelectric generator and said solenoid in such a way that, with the control element in a first condition, the electric current generated by the thermoelectric generator reaches the solenoid to keep the safety solenoid valve in said open condition and, with the control element in a second condition, the electric current generated by the thermoelectric generator is interrupted or reduced before reaching the solenoid, thereby causing the safety solenoid valve to pass in a respective closed condition, wherein the timing device, the control element and the command arrangement belong to a control circuit which is electrically coupled with the solenoid safety valve, wherein at least one of the timing device and the control element belongs to a functional unit prearranged to be mechanically coupled with a portion of the gas tap body, wherein said at least one signaling element comprises a display device selected from among numerical display devices, alphanumerical display devices, graphical display devices and wireless display devices, wherein said control circuit is prearranged for transmission and/or reception of data with respect to said display device, wherein the command arrangement comprises a sensor device in signal communication with the timing device, the sensor device comprising one of;

a touch sensitive sensor device, configured for detecting commands by a user;

a sensor device configured for detecting a displacement of a manually operable command element belonging to the command arrangement; and a contactless sensor, and wherein said display device is configured for signaling at least one of:

a status of a timing function of the gas supply control device;

approaching of elapsing of the time interval set through the command arrangement of the gas supply control device; and elapsing of the time interval set through the command arrangement of the gas supply control device.

* * * * *